United States Patent [19]

Bergman

[11] 4,405,342

[45] Sep. 20, 1983

[54] ELECTRIC FILTER WITH MOVABLE BELT ELECTRODE

[75] Inventor: Werner Bergman, Pleasanton, Calif.

[73] Assignee: The United States of America as represented by the U.S. Department of Energy, Washington, D.C.

[21] Appl. No.: 351,679

[22] Filed: Feb. 23, 1982

[51] Int. Cl.[3] ..... B03C 3/00

[52] U.S. Cl. ..... 55/6; 55/132; 55/149; 55/154; 55/155; 55/352; 55/354

[58] Field of Search ..... 55/113, 116, 131, 132, 55/154, 155, 149, 352, 354, 6

[56] References Cited

U.S. PATENT DOCUMENTS

| | | |
|---|---|---|
| 2,297,601 | 9/1942 | Williams . |
| 2,502,560 | 4/1950 | Dahlman . |
| 2,579,440 | 12/1951 | Palmer . |
| 2,588,111 | 3/1952 | Hanneman . |
| 2,818,134 | 12/1957 | Powers . |
| 2,847,082 | 8/1958 | Roos . |
| 2,868,319 | 1/1959 | Rivers . |
| 2,888,092 | 5/1959 | Powers . |
| 2,908,348 | 10/1959 | Rivers . |
| 2,917,130 | 12/1959 | Powers . |
| 3,181,284 | 5/1965 | Copenhefer . |
| 3,242,649 | 3/1966 | Rivers . |
| 3,375,638 | 4/1968 | Dungler . |
| 3,537,238 | 11/1970 | Dungler . |
| 3,581,468 | 6/1971 | Gourdine et al. . |
| 3,626,668 | 12/1971 | Cardiff . |
| 3,701,236 | 10/1972 | Rotsky et al. . |
| 3,744,216 | 7/1973 | Halloran . |
| 3,745,748 | 7/1973 | Goldfield et al. . |
| 3,800,509 | 4/1974 | Carr et al. . |
| 3,841,840 | 10/1974 | Hundhausen et al. . |
| 3,873,281 | 3/1975 | Himes et al. . |
| 3,997,304 | 12/1976 | Carr . |
| 4,035,164 | 7/1977 | Taylor . |
| 4,116,789 | 9/1978 | Kins . |
| 4,229,187 | 10/1980 | Stockford . |

FOREIGN PATENT DOCUMENTS

| | | | |
|---|---|---|---|
| 794038 | 4/1958 | United Kingdom | 55/149 |

OTHER PUBLICATIONS

UCRL-84454-Electrofibrous Prefillers for Use in Nuclear Ventilation Stations, Bergman et al., 10/20-23/80, pp. 1-30.

*Primary Examiner*—Bernard Nozick

*Attorney, Agent, or Firm*—Paul Davis; L. E. Carnahan; Richard G. Besha

[57] ABSTRACT

A method and apparatus for removing airborne contaminants entrained in a gas or airstream includes an electric filter characterized by a movable endless belt electrode, a grounded electrode, and a filter medium sandwiched therebetween. Inclusion of the movable, endless belt electrode provides the driving force for advancing the filter medium through the filter, and reduces frictional drag on the filter medium, thereby permitting a wide choice of filter medium materials. Additionally, the belt electrode includes a plurality of pleats in order to provide maximum surface area on which to collect airborne contaminants.

10 Claims, 4 Drawing Figures

ELECTRIC FILTER WITH MOVABLE BELT ELECTRODE

BACKGROUND OF THE INVENTION

The U.S. Government has rights in this invention pursuant to Contract No. W-7405-ENG-48 between the U.S. Department of Energy and the University of California for the operation of the Lawrence Livermore National Laboratory. The present invention relates generally to methods and apparatus for purifying airstreams employing electric filters, and more particularly to electric filters including at least one movable belt electrode.

Numerous methods and apparatus are known and utilized to remove airborne contaminants from airstreams. One commonly used apparatus is the electric precipitator, which generally involves a two-step process to remove liquid droplets or solid particles from the gas stream where they are suspended. In the first step, the suspended particles pass through an electric discharge area to ionize the gas. The ions produced collide with the suspended particles and confer on them an electric charge.

In the second step, the charged particles are precipitated on a series of electrode plates that have a high voltage gradient imposed between the electrodes. Electric precipitators can also be designed so that the particles are both charged and precipitated in the same area, e.g., a one-step process. Efficiency of electric precipitators is limited by the resistance of the dust to be collected, and the area of the collector plates relative to the volume of air cleaned. Dust particles must generally have resistivities between $5\times10^3$ and $2\times10^{10}$ ohm/cm to be efficiently collected. Outside this range, particles are not efficiently collected, and therefore significantly restricts the applications of electric precipitators. Electrostatic precipitators are cable of removing only particulate matter, not objectionable gases. Exemplary electric precipitators are disclosed in U.S. Pat. Nos. 3,626,668; 2,579,440; 3,581,468; and 3,701,236.

Another type of apparatus frequently used to remove airborne contaminants is a filter, designed as an assembly of very small obstacles such as fibers or spheres, integrally bound together or a loosely bound aggregate through which the dirty air flows. In some of these devices, the clean filter acts to support a layer of particle deposit which is the primary filtering agent. The mechanical filter captures particles because the particles' inertia and diffusion causes a collision with the filter media. Although the collection efficiency for the individual collectors comprising the filter medium is not very large, the large number of collectors in a typical filter medium makes the overall efficiency very high. This large collection area in mechanical filters accounts for their higher efficiency when compared to electric precipitators. Unfortunately, the larger collection area in mechanical filters also produces higher restrictions to air flow than electric precipitators.

An improvement in filter performance is realized by electrifying the filter medium to increase filter efficiency and filter life. In this regard, electric filters represent the best technology for removing such airborne contaminants. These filters are based upon the concept of either charging or polarizing a filter medium and generating an electrical force between the medium and particles. Primary methods for generating electric filters include precharging aerosols, polarizing the filter media with electric fields, and permanently charging the fibers.

Compared to a conventional filter, the electrofibrous filter has a much higher efficiency. When an external electric field is first applied to the filter medium, the only capture mechanism is due to the forces between the polarized medium and the polarized or charged particles. The electric field instantly polarizes the medium, which then attracts both charged and polarized particles. Charged particles that deposit on the medium then gradually build up a charge. Increased filter efficiency is thus due to a time-independent attraction between polarized medium and aerosols, and a time-dependent attraction between charged medium and aerosols. Exemplary electric filters are disclosed in U.S. Pat. Nos. 3,800,509; 3,375,638; and 3,537,238.

The electric filters disclosed in the preceding patents all pull the medium over stationary electrodes. Although electric filters using stationary electrodes have a generally simple design, they suffer from excessive tension on filter medium that is required to overcome the frictional forces between the filter medium and the stationary electrode. This tension on the filter medium greatly restricts the choice of medium which may be employed, and generally requires that the medium possess high tensile strength at a cost of decreased efficiency. A further limitation of the above-referenced electric filters is their failure to provide maximum filter medium surface area, e.g., the filter medium traverses in a direction generally perpendicular to air stream flow. This geometric configuration significantly decreases efficiency, while increasing air flow resistance of the electric filters.

SUMMARY OF THE INVENTION

Accordingly, an object of the invention is to provide a method and apparatus for removing airborne contaminants entrained in a gas stream, wherein filter efficiency of the electric filter is maximized.

Another object of the invention is to provide a method and apparatus for removing airborne contaminants from an air stream in an electric filter, wherein air flow resistance is minimized.

Yet another object of the invention is to provide a method and apparatus for removing airborne contaminants found in a gas stream, wherein frictional drag of the filter medium within an electric filter is minimized.

Still another object of the invention is to provide a method and apparatus for filtering out airborne contaminants in a gas stream, wherein tensile strength of the filter medium is not maximized.

A further object of the invention is to provide a method and apparatus for removing airborne contaminants in a gas stream, wherein a variety of filter medium materials may be employed.

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

To achieve the foregoing and other objects, and in accordance with the purpose of the present invention as embodied and broadly described herein, the electric filter may comprise a movable, endless, perforated belt electrode, having a plurality of pleats arranged generally in a longitudinal direction with respect to the flow of a gas stream to be purified. A grounded electrode, adapted to fit in a closely-mated, spaced-apart relationship with the belt electrode along the area of the pleats, is also provided. The grounded electrode includes a plurality of perforations, to permit the flow of a gas stream therethrough. Sandwiched between the two electrodes is a filter medium, engaged with both electrodes and advanced within the electric filter by movement of the belt electrode. Means for supplying voltage to the belt electrode, and motor means connected to the belt electrode are also included. The motor means provide the power which advances the belt electrode and filter medium.

In a further aspect of the present invention, in accordance with its objects and purposes, a method for removing contaminants found in an airstream may comprise providing an electric filter characterized by a movable, endless, perforated belt electrode having a plurality of pleats arranged generally longitudinally with respect to the flow of the gas stream. The filter also includes a grounded electrode, adapted to be in a closely-mated, spaced-apart relationship with the belt electrode, and a filter medium sandwiched between and engaged with each electrode. The filter medium is polarized by forming an electric field between the electrodes. Thereafter, an airstream is passed through the electric filter in a direction generally longitudinal with respect to the pleats of the belt electrode. Contaminants dispersed throughout the airstream are then collected on the polarized filter medium.

By providing an endless movable belt electrode, frictional drag on the filter medium within the filter is greatly reduced. Reducing frictional drag alleviates the requirement that the filter medium possess high tensile strength. Hence, greater variety in terms of filter medium choice is permitted. Generally filter medium choices with lower tensile strength yield enhanced filter efficiency. Pleating the movable endless belt electrode within the electric filter along the longitudinal flow direction of a gas stream to be purified, resulting in a similar pleating effect on the filter medium therein, increases the surface area of the filter medium and maximizes filter efficiency.

BRIEF DESCRIPTION OF THE DRAWINGS

The accompanying drawings, which are incorporated and form a part of the specification, illustrate many embodiments of the invention, and, together with the description, serve to explain the principles of the invention.

DETAILED DESCRIPTION OF THE INVENTION

Figure 1:
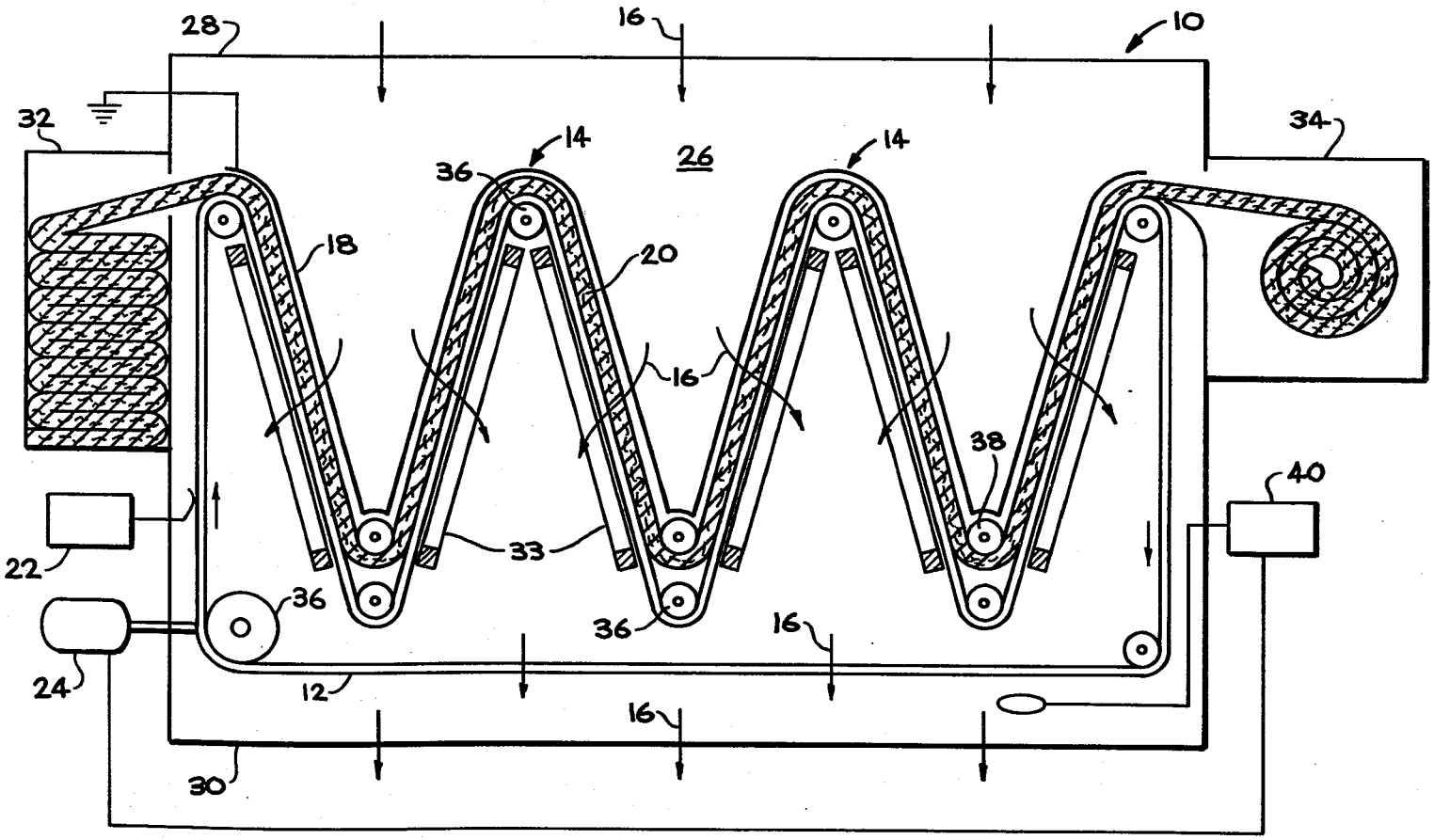
FIG. 1 illustrates a schematic view of one embodiment of the electric filter, employing a movable endless belt electrode and a stationary grounded electrode.

The electric filter 10 illustrated in FIG. 1 comprises a movable, endless, perforated belt electrode 12, which includes a plurality of pleats 14 arranged generally longitudinal with respect to the flow 16 of a gas stream which is to be purified. A grounded electrode 18, adapted to fit in a clsely-mated, spaced-apart relationship with belt electrode 12 along pleats 14, includes a plurality of perforations (not shown) to permit the flow of the gas stream therethrough. A filter medium 20 is in engagement with and sandwiched between the two electrodes, and is advanced through electric filter 10 by movement therein of belt electrode 12.

Power means 22, connected to belt electrode 12, is included to supply high voltage to the electrode. Suitable power means include low cost solid state power supplies which effectively step 110 volts up to approximately 15,000 volts with very little current output. Preferably, the power supply is d.c. rather than a.c., in order to maintain a charge build-up on the filter medium. Power means 22 provides about 8,000 to 12,000 volts to belt electrode 12 at a low current less than 100$\mu$ amps.

Motor means 24 is provided, and connected to belt electrode 12 in order to provide a mechanism to advance the belt electrode. Such motor means is well known in the art, and can include, for example, gears connected to belt electrode 12 and powered by an electric motor. Both electrodes are housed in a filtration chamber 26 which includes apertures disposed within opposing wall members 28 and 30, to permit the entrance and exit of the gas stream therein. Positioned at the exterior of filtration chamber 26 is a filter medium container 32, housing a continuous supply of filter medium for the electric filter. As the medium within housing 32 becomes depleted, fresh filter medium is introduced into the housing, thereby permitting a continuous flow of the medium into the electric filter. Preferably, the filter medium disposed within housing 32 is in a pleated configuration, as to maximize the amount of medium disposed within the housing at any one time, allowing the end of one medium sheet to be attached to the beginning of another medium sheet. Also positioned at the exterior of filtration chamber 26 is a collection vessel 34, for receiving filter medium from electric filter 10 which has become saturated with the collected airborne contaminants removed from air flow 16.

Stationary structural supports 33 are included with filtration chamber 26 to provide structural support for belt electrode 12. This support permits the use of less expensive belt electrodes, and additionally allows for an increase in the amount of belt perforation. Structural supports 33 have a relatively large open area to permit air to pass through.

Included within the interior of filtration chamber 26 are a plurality of roll members 36, operatively connected with motor means 24, in order to enable the advancement of belt electrode 12 therein. Roll members 36 are of conventional design, and may be pulleys, disks, or (preferably) chains and sprockets touching the electrode 12. Included within the interior of filtratiom chamber 26 are a plurality of chain-driven sprockets 38 disposed within each pleat 14 between filter medium 20 and grounded electrode 18, to assist in advancing the filter medium. Roll members 36 and 38 may be separately placed, as shown in FIG. 1, or may be fastened on the same shaft.

In operation of electric filter 10 illustrated in FIG. 1, air flow 16 passes through wall member 28, and enters the interior of filtration chamber 26 through the action of an external pumping or blowing system (not shown). A high voltage of about 8,000–12,000 volts is applied to belt electrode 12, resulting in the polarization of filter medium 20. Air flow 16 passes through grounded electrode 18, contacting the polarized filter medium 20. Airborne contaminants entrained in air flow 16 becomes deposited on filter medium 20, and thereafter passes through the filter medium to belt electrode 12. From there, the air flow travels through belt electrode 12 and exits from filtration chamber 26 through wall member 30. Inclusion of pleats 14 as part of belt electrode 12 decreases the face velocity of air flow 16. Face velocity used herein is defined as the flow rate divided by the filter medium area. For highest filter efficiency and lowest air resistance, the face velocity of the air flow should be kept to a minimum.

Movement of belt electrode 12 and filter medium 20 within filtration chamber 26 may be continuous, at a predetermined rate in order to enable efficient collection of airborne contaminants. Alternatively, belt electrode 12 may be advanced in a stop-and-go manner as filter medium 20 becomes clogged or loses efficiency due to the collection of airborne contaminants. To this end, detection means 40 are provided and operatively connected with belt electrode 12 and motor means 24 to measure the air resistance or air flow across filter medium 20, or alternatively the concentration of airborne contaminants. For this purpose a differential pressure gauge is suitable. Once a predetermined air resistance, air flow, or concentration of airborne contaminants is reached, as measured by detection means 40, a signal is sent from detection means 40 to motor means 24 which advances movement of belt electrode 12 within filtration chamber 26. Suitable detection means include a pressure transducer, differential pressure gauge, hot wire gnemometer, or other appropriate analytical instrumentation.

In choosing a proper filter medium, the following parameters are preferably minimized: conductivity; medium packing density; compressibility; and water absorption. Relatively low medium conductivity is desirable in order to maintain filter medium polarization, and prevent short circuiting belt electrode 12. Low filter medium packing density and compressibility are desirable in order to increase the contaminant-holding capacity in the filter medium, and hence promote filter efficiency. Minimum water absorption for the filter medium is necessary to minimize surface conductivity on the medium. As previously mentioned, increased conductivity leads to increased current flow across the filter medium, and eventually results in short circuiting belt electrode 12. A further requirement for the filter medium is low flamability. Suitable materials for the filter medium typically exhibit one or more of the above characteristics; however, the material may be lacking in other characteristics. For example, glass fibers are nonflammable, but are moderately conductive. In contrast, plastic fibers such as polypropylene have very low conductivities, but are flammable. Choice of filter medium, therefore, is dependent upon the use to which the electric filter is employed. Additionally, the choice is dependent on the nature of the airborne contaminant. For example, a glass fiber mat would be an appropriate choice for removal of acids such as HF and $HNO_3$, as well as particulate contaminants. For the removal of organic vapors, activated carbon is suitable. Suitable filter medium materials include, but are not limited to, granular carbon, fiberglass, sand, and other loose aggregate materials.

Around the periphery of filtration chamber 26 and along the edges of the filter medium, leakage of air flow 16 may be encountered. To alleviate this problem, a compression seal is provided along the edges of filtration chamber 26. The compression seal is achieved by providing a continuous slot (not shown) in the chamber along the path where filter medium 20 travels.

Figure 2:
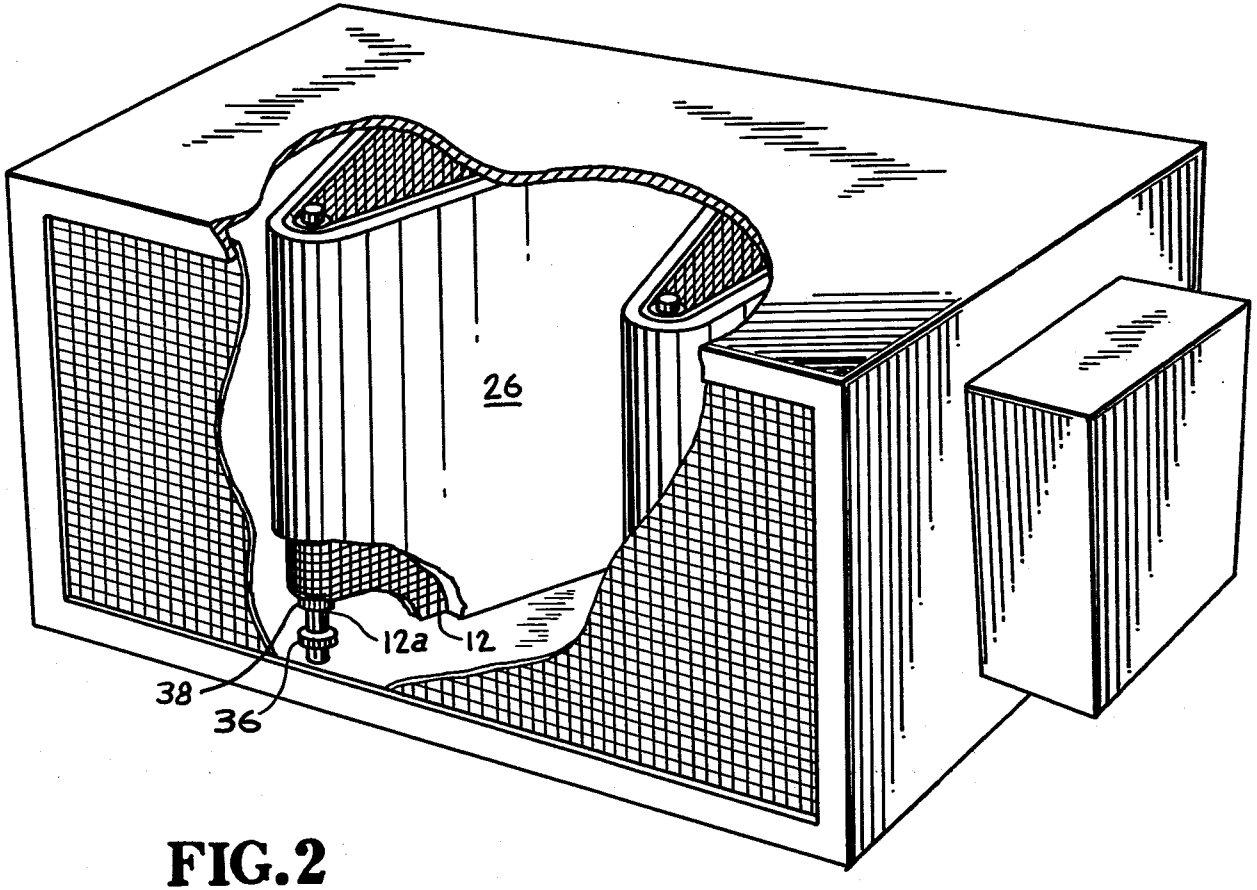
FIG. 2 illustrates a perspective view of the electric filter of FIG. 1, and shows the pleated configuration of the movable belt electrode after the stationary grounded electrode has been removed.

Referring now to the perspective view of electric filter 10 illustrated in FIG. 2, belt electrode 12 is shown as a mesh screen draped over supporting rods **12*a*, forming a belt. Belt electrode may be formed from a metal substance such as stainless steel, or a lightweight plastic screen covered with a conductive coating. Roll members 36 are utilized to provide pivotal points for changes in belt electrode 12 direction. Roll members 38 are utilized to provide pivotal points for changes in filter media direction. As shown in FIG. 2, the roll members 36 and 38 are fastened on the same supporting rod 12*a*. Because a high voltage is applied to belt electrode 12, it is insulated from filtration chamber 26 by providing sheets of a nonconductive material, such as polyethylene or polycarbonate. In addition to this insulation, all other connections to belt electrode 12, e.g., roll members 36, are made from similar nonconductive materials. Belt electrode 12 not only advances filter medium 20 throughout filtration chamber 26, but additionally provides support for the filter medium. Because of this, it is necessary that belt electrode 12 have more structural support than the grounded electrode. For this reason, approximately 40% of the surface area of belt electrode 12** is perforated, whereas approximately 80% of the grounded electrode is perforated.

Figure 3:
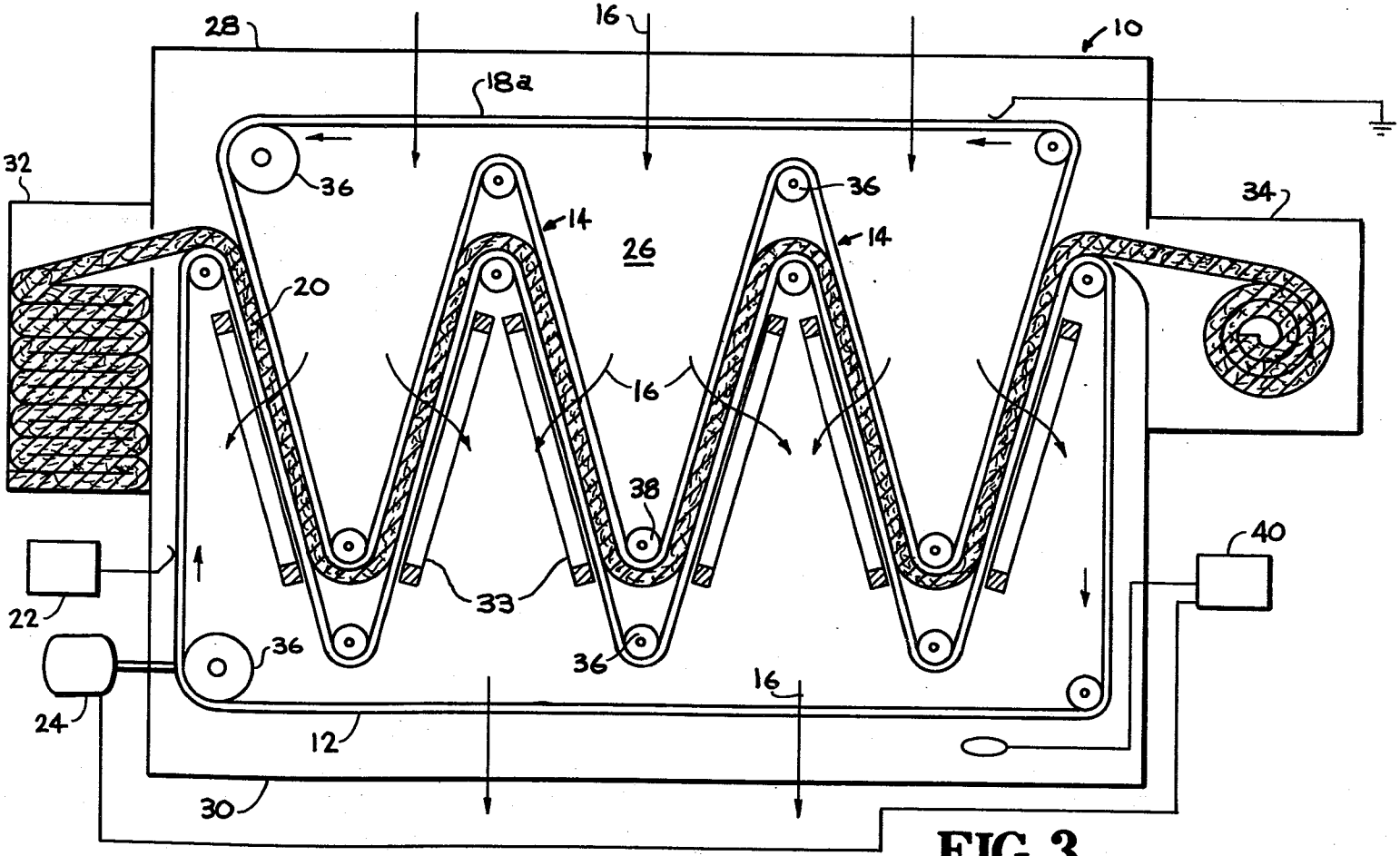
FIG. 3 illustrates a schematic view of a second embodiment of the electric filter, employing a movable belt electrode and a movable grounded electrode.

FIG. 3 illustrates a second embodiment of the electric filter, replacing grounded electrode 18 of FIG. 1 as a movable ground belt electrode **18*a*, similar to high voltage belt electrode 12. As shown, grounded electrode 18*a* moves in conformity with high voltage electrode 12, and is in operational contact with motor means 24 and detection means 40. In this regard, movement of filter medium 20** through the filter is enhanced by the movement of both electrodes, thereby minimizing frictional drag on the medium.

Figure 4:
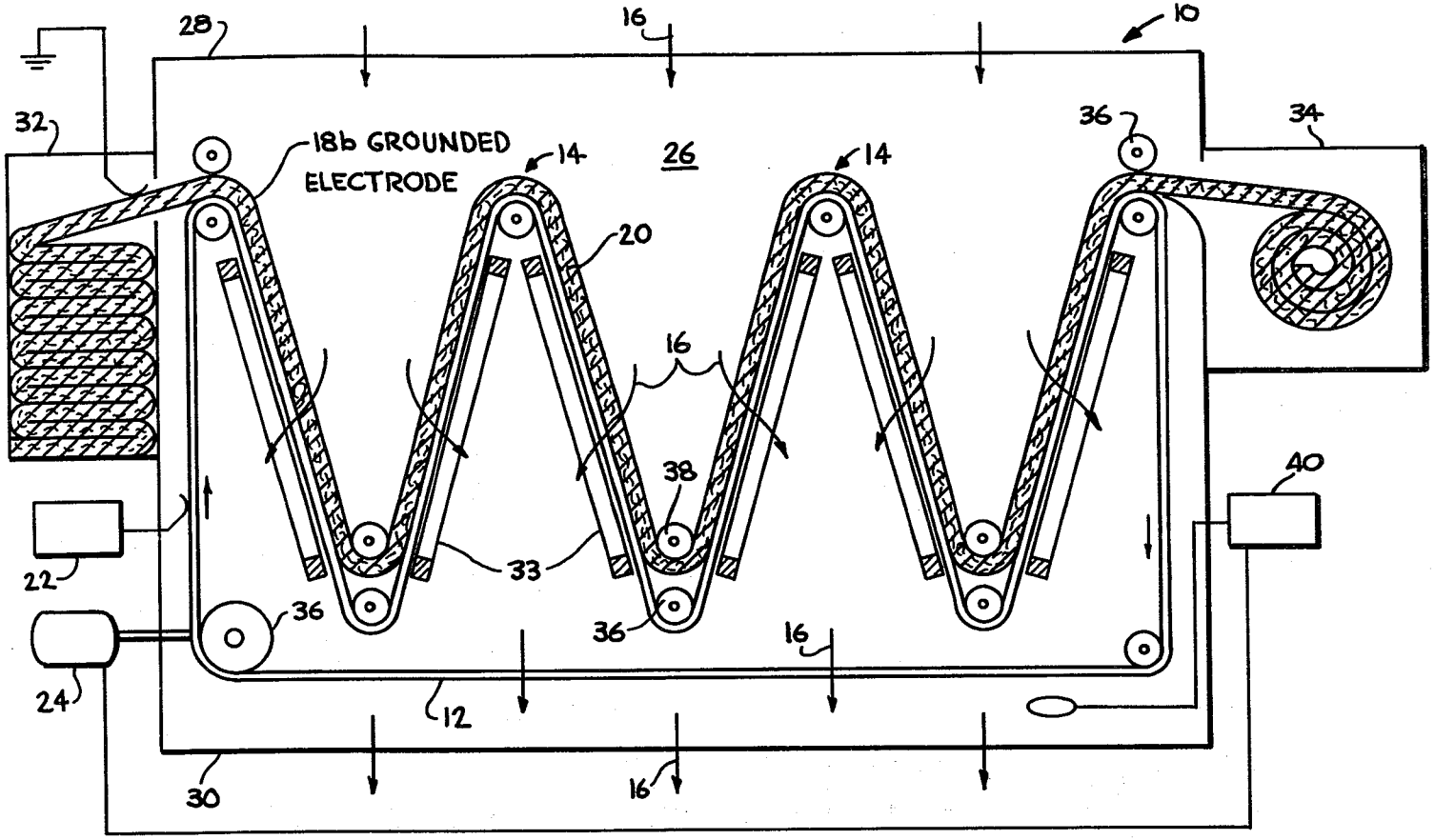
FIG. 4 illustrates a schematic view of a third embodiment of the electric filter, employing a movable belt electrode, and a grounded electrode attached to the filter medium.

A third embodiment of the electric filter is illustrated in FIG. 4. In this embodiment, the grounded electrode is affixed to filter medium 20, e.g., a sheet of an electrode **18*b* (maintained at ground) is affixed to the filter medium, and advanced within electric filter 10 by movement of belt electrode 12 which in turn moves filter medium 20. The combination of chain-drive sprockets 38 disclosed in FIG. 1 and the force of air flow 16 against electrode 12 provide sufficient engagement of filter medium 20 with electrode 12. Thus as electrode 12 ad vances, filter medium 20, with integral electrode 18*b***, also advances.

In a fourth embodiment, the filter medium consists of granular material constrained by the grounded belt electrode **18*a* and the high voltage belt electrode 12 shown in FIG. 3**. Because the granular medium has no structure, means must be provided for introducing the medium into the filter and for removing the spent media. Although a great variety of means of introducing the medium into the filter are envisioned, a motordriven, screw-fed mechanism (not shown) may be employed. In the alternative, the granular medium may be disposed at a higher elevation than the filter, allowing gravity to provide the feed and removal of medium.

The electric filters of the present invention are particularly useful as pre-filters in combination with high efficiency particulate air (HEPA) filters, commonly used in the nuclear industry. HEPA filters generate a significant volume of radioactive waste, and are costly to purchase and operate. Use of electric filters in combination with the HEPA filter reduces operational costs and minimizes the volume of radioactive wastes which are generated. Of course, the electric filters of the present invention will find use in most environments wherein the removal of airborne contaminants from a stream of gas or air is desirable.

The foregoing description of preferred embodiments of the present invention has been presented for purposes of illustration and description. It is intended that the scope of the invention be defined by the claims appended hereto.

I claim:

1. A method for removing contaminants from an air stream, comprising:

providing an electric filter characterized by a movable, endless, perforated belt electrode having a plurality of pleats arranged generally longitudinally with respect to the flow of a gas stream, a grounded electrode adapted to fit in a closely-mated, spaced-apart relationship with said belt electrode, and a filter medium sandwiched between and engaged with said electrodes;

polarizing said filter medium by forming an electric field between said electrodes;

passing an air stream through said electric filter in a direction generally longitudinal with respect to said pleats; and collecting contaminants dispersed throughout said air stream on said filter medium.

2. The method for removing contaminants according to claim 1, further comprising:

advancing said belt electrode and filter medium once a predetermined air resistance or air flow has been reached; and introducing fresh filter medium into said electric filter in the vicinity of said pleats.

3. The method for removing contaminants according to claim 1, wherein said filter medium is polarized by applying a voltage of about 8,000 to 12,000 volts to said belt electrode.

4. An electric filter, comprising:

a movable, endless, perforated belt electrode, having a plurality of pleats arranged generally longitudinally with respect to the flow of a gas stream to be purified;

a grounded electrode adapted to fit in a closely-mated, spaced-apart relationship with said belt electrode along said pleats, said grounded electrode including a plurality of perforations to permit the flow of a gas stream therethrough;

a filter medium sandwiched between and engaged with said electrodes, advanced and movable therein by the movement of said belt electrode;

means for supplying voltage to said belt electrode; and means connected to said belt electrode, providing power to advance said belt electrode and filter medium.

5. The electric filter according to claim 4, further comprising wall members defining a filtration chamber housing said electrodes, said chamber including apertures disposed within opposing wall members to permit the entrance and exit of a gas stream therein.

6. The electric filter according to claim 4, further including detection means for detecting air resistance or air flow as a result of the collection of contaminants on said filter medium, said detection means being operatively connected to said motor means for causing activation thereof to advance said belt electrode and filter medium when a predetermined air resistance or air flow have been reached.

7. The electric filter according to claim 6, wherein said detection means comprises a pressure transducer.

8. The electric filter according to claim 4, wherein said grounded electrode is stationary with respect to the movement of said belt electrode and filter medium.

9. The electric filter according to claim 4, wherein said grounded electrode comprises a movable, endless belt electrode.

10. The electric filter according to claim 4, wherein said grounded electrode is attached to said filter medium.

* * * * *